US005176220A

United States Patent [19]

Akkerman

[11] Patent Number: 5,176,220

[45] Date of Patent: Jan. 5, 1993

[54] SUBSURFACE TUBING SAFETY VALVE

[75] Inventor: Neil H. Akkerman, Houston, Tex.

[73] Assignee: AVA International, Inc., Houston, Tex.

[21] Appl. No.: 782,560

[22] Filed: Oct. 25, 1991

[51] Int. Cl.[5] ..... E21B 34/08

[52] U.S. Cl. ..... 166/321; 166/324; 166/332

[58] Field of Search ..... 166/319, 320, 321, 323, 166/324, 332

[56] References Cited

U.S. PATENT DOCUMENTS

| | | | |
|---|---|---|---|
| 4,331,315 | 5/1982 | Geisow | 166/332 X |
| 4,340,088 | 7/1982 | Geisow | 166/332 X |
| 4,349,043 | 9/1982 | Christensen | 166/319 X |
| 4,768,594 | 9/1988 | Akkerman | 166/319 |

*Primary Examiner*—William P. Neuder
*Attorney, Agent, or Firm*—Vaden, Eickenroht, Thompson, Boulware & Feather

[57] ABSTRACT

There is disclosed a subsurface tubing safety valve comprising a body having ports therein connecting the bore of the body with the annulus thereabout, a sleeve for reciprocating in the body between positions opening and closing the ports, and a piston which reciprocates within the sleeve, and a pair of coil springs, a first of which acts between the piston and sleeve and a second of which acts between the sleeve and body. When the sleeve is raised to its open position, the piston may be caused to move upwardly within the sleeve in response to a predetermined increase in pressure differential acting upwardly across the piston so as to compress and generate energy in both springs. As the piston moves up, the sleeve is connected to it for downward movement therewith in response to a predetermined decrease in the pressure differential across the piston to a position in which the sleeve is released by an expandable end of a bellows in response to a predetermined drop in the pressure of the well fluid.

35 Claims, 3 Drawing Sheets

20

20

SUBSURFACE TUBING SAFETY VALVE

This invention relates generally to subsurface tubing safety valves, and, more particularly, to improvements in such valves of the subsurface controlled type which are adapted to "fail"closed in response to a predetermined increase in the rate of flow of well fluid through the well tubing.

As well known in the art, an increase in the flow rate is indicative of one or more problems, such as a blowout, which require that the lower end of the tubing be closed at a substantial depth below the surface Conventionally, valves of this type, often called "storm chokes", are adapted to close automatically in response to a predetermined decrease in the downhole pressure, which is inversely proportional to the flow rate. One version of a valve of the type has a closure member normally spring pressed to a position opening an orifice therethrough, but adapted to close in response to a predetermined pressure drop across the orifice and thus responsive to excess flow of well fluid. In another version of a valve of this type, the closure member is automatically moved to closed position by a gas charged piston assembly which is sensitive to the pressure of the well fluid. Typically, the assembly in charged with nitrogen at a pressure adapted to respond to predicted conditions, including temperature as well as pressure of the well fluid. Thus, one end of the piston may be arranged to move a poppet to closed position as it expands in response to a predetermined drop in the well fluid pressure.

These and similar valves of this type throttle the well in that the pressure of the well fluid increases as the closure member moves to closed position. As a result, the closure member may reach an equilibrium point at which it is only partially closed, thus causing excessive erosion on the valve. In an effort to make such a valve snap-acting, and thus close before a build-up in well pressure, it has been proposed to retain the closure member in open position by a snap ring or detent which releases only in response to a predetermined build-up in the force exerted by the piston assembly to close the poppet. However, the point at which devices of this type release depends on the lubricity of the well fluid, which is unpredictable and thus doesn't permit the user to accurately predetermine the flow rate at which the valve is to close.

U.S. Pat. No. 4,768,594 discloses a subsurface tubing safety valve which is bi-stable in that it is neither normally closed nor open and closes independently of changes in well pressure. Hence, it includes a means by which energy is generated and stored in response to the control of the differential pressure across the closure member, when in its closed position, for use in opening and then closing the valve. More particularly, a first portion of the generated energy is released to move the closure member to open position, in response to a predetermined change in the pressure differential, and a second portion is initially held by a latch which is released in response the loss of the supply of electrical power from the surface, to move the valve to closed position.

It is an object of this invention to provide a subsurface controlled, subsurface tubing safety valve which instead of closing in response to changes in pressure of the well fluid, as in prior valves of this type, is bi-stable in that, as in the case of the surface controlled valve above-described, it enables energy to be generated in response to a predetermined differential pressure of well fluid across the closed closure member for use in opening the valve upon a response to a predetermined change in the differential pressure and then closing it in response to a predetermined increase in the flow rate of the well fluid.

This and other objects are accomplished, in accordance with the present invention, by a subsurface safety valve which includes, as in the case of the valve of U.S. Pat. No. 4,765,594, a tubular body adapted to be installed in a tubing string suspended within a well bore, means including a closure member movable between positions opening and closing the flowway, and means within the body and responsive to a predetermined differential in the pressure of the well fluid across the closure member for generating and storing energy for moving the closure member between opened and closed positions. More particularly, the valve also includes means which is operable, in response to a predetermined change in the pressure differential across the closure member, to release a portion of the energy for moving the closure member to open position, and means responsive to a predetermined increase in the rate of flow of the well fluid for releasing further energy to move the closure member to closed position. Preferably, the releasing means is also responsive to a predetermined decrease in the rate of flow of well fluid for return to a position from which it may release further generated energy upon return of the closure member to open position.

In the preferred and illustrated embodiment of the invention, the tubular body has ports connecting its bore with the annulus about the body, and the closure member includes a sleeve sealably reciprocable within the body between a lower position to open the ports and an upper position to close the ports and means including a piston sealably reciprocable within the sleeve between an upper limited position and a lower position and operable, when the sleeve is in its closed position and in response to a predetermined increase in the differential pressure of well fluid acting upwardly across the piston, to generate energy for moving the sleeve between its upper and lower positions. Moreover, the valve also includes means which is operable, upon raising of the piston with respect to the sleeve, for releasably connecting the sleeve to the piston for downward movement with piston, whereby, in response to a predetermined decrease in the pressure differential acting upwardly across the piston, a portion of the generated energy is released to lower the piston to open the ports, as well as means which, in response to the predetermined increase in the flow rate of the well fluid within the body, releases the connecting means to permit further generated energy to raise the sleeve to close the ports. More particularly, as the flow rate of the well fluid decreases upon closing of the sleeve, the releasing means is returned to a position from which it may again release the connecting means upon lowering of the sleeve with the piston.

In the preferred and illustrated embodiment of the invention, the energy is generated in a pair of springs, a first of which acts between the piston and sleeve and a second of which acts between the sleeve and body, and both of which are compressed in response to raising of the piston to its upper position when the valve is closed and the pressure differential across the piston is increased. Thus, when the sleeve is in closed position and the pressure differential across the piston is decreased, energy generated in the second spring serves to lower the sleeve to open position, and, when the connection of the sleeve to the piston is released, energy generated in the second spring serves to raise the sleeve to closed position.

In the preferred and illustrated embodiment of the invention, the connecting means comprises a latch on the lower end of the sleeve which is normally urged to a position connected to the piston and yieldable upon engageable by the one end of the bellows to a position releasing the piston. More particularly, the latch comprises a collet having fingers with tapered faces, and the one end of the bellows has a tapered surface for sliding over the tapered faces to wedge the fingers outwardly to releasing position.

In the illustrated embodiment of the invention, the releasing means comprises means which expands and contracts in response to a decrease and an increase respectively in the pressure of the well fluid. More particularly, it includes a bellows having one end which is expandable with respect to its other end fixed to the body to engage and release the connecting means in response to the predetermined drop in the pressure of the well fluid. Although the bellows may be changed with nitrogen, as is conventional, it is preferably welded to its opposite ends under atmospheric conditions, and a spring means is arranged to yieldably urge the one end to its expanded position, whereby a vacuum is drawn on the inside of the bellows such that the bellows is insensitive to temperature fluctuations for which it might be designed. More particularly, a rod extends closely with the bellows and oil is contained between the rod and bellows to prevent collapse of the bellows under extreme well pressure.

In the drawings, wherein like reference characters are used throughout the designate like parts:

Figure 1A:
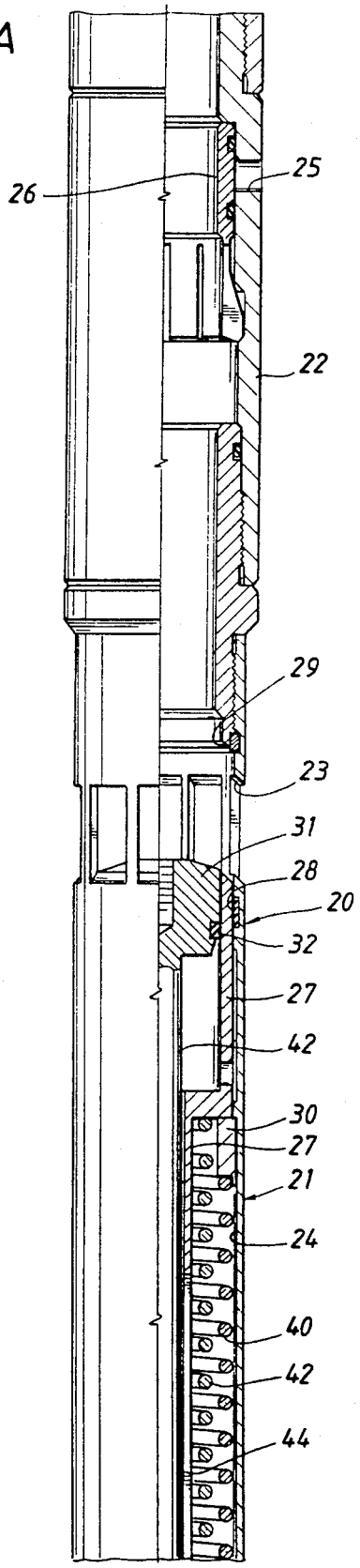
FIG. 1A and 1B are views, partly in elevation and partly in section, of the upper and lower ends of a subsurface tubing safety valve constructed in accordance with the present invention, and showing the sleeve thereof in its lower position to open ports in the valve, the piston raised to its upper position within the sleeve, and the sleeve latched to the piston for downward movement therewith.
Figure 1B:
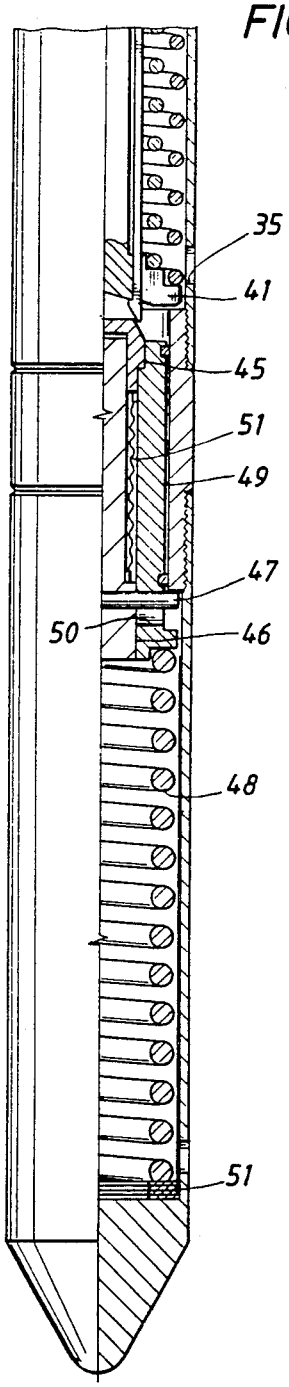
Figure 3:
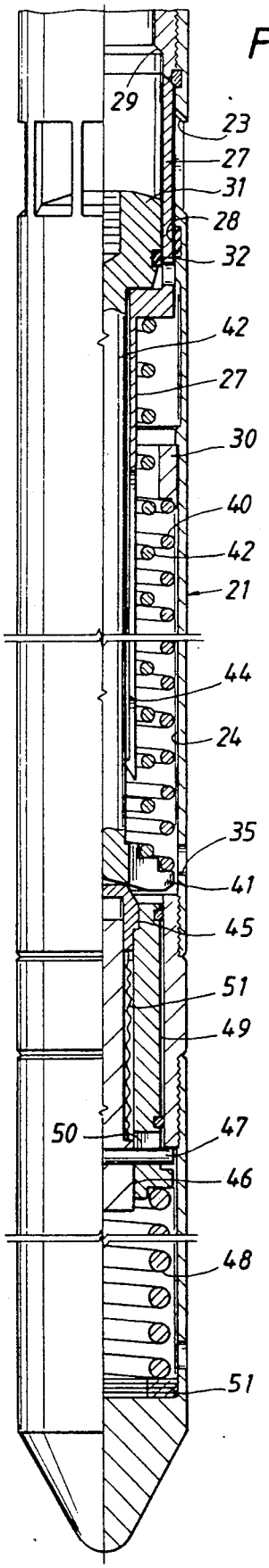
FIG. 3 is a view similar to FIG. 2, but upon raising of the released sleeve to its upper position to close the ports in the valve in response to expansion of the closing spring.
Figure 4:
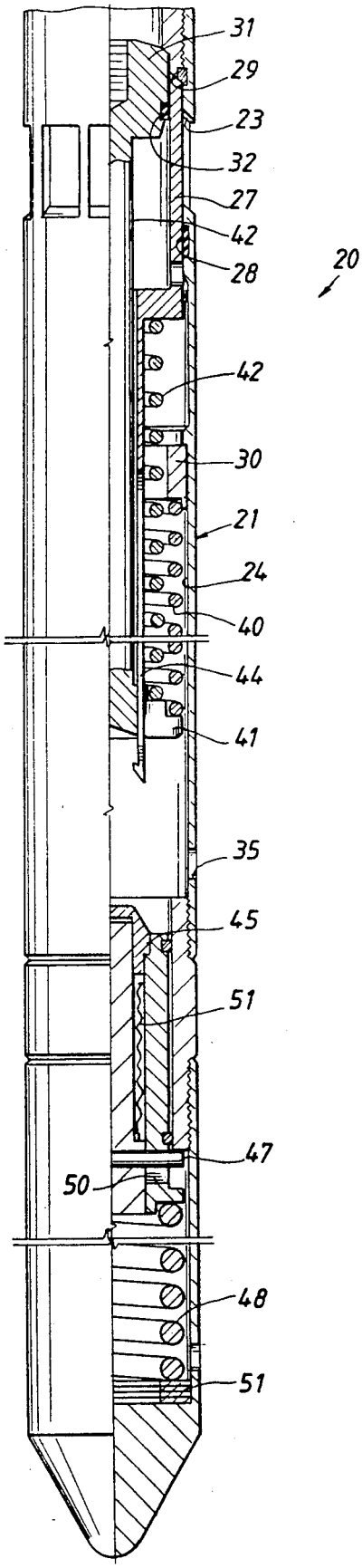
Figure 5:
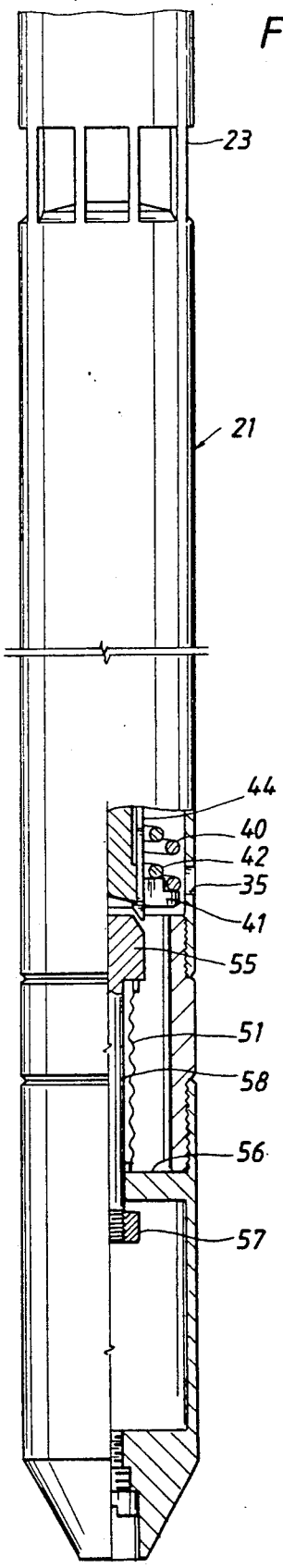

FIG. 4 is another view of the valve similar to FIG. 3, but upon raising of the piston to its upper limited position, in response to an increase in the pressure differential acting upwardly across it, so as to compress and thus store energy both the closing and opening springs; and FIG. 5 is a view of an alternative embodiment of the valve having its lower end shown in section to illustrate a nitrogen charged bellows for use in releasing the sleeve which has been lowered with the piston to open the valve, as in FIGS. 1A and 1B.

With reference now to the details of the above described drawings, the overall valve shown in FIGS. 1A, 1B, 2, 3 and 4, and indicated in its entirety by reference character 20, is shown to comprise a tubular body 21 having an open upper end connected to the lower end of a tubing string 22 suspended within and packed off within a well bore (not shown) and a closed lower end. The body 21 has ports 23 therein which form a flowway to connect its bore with the annulus between the body and the well bore beneath the packer and which are adapted to be opened and closed as described below, in order to respectively permit well fluid within the annulus beneath the packer to flow into the tubing or shut in well fluid in the tubing.

As shown in FIG. 1A, additional ports 25 are also formed in the body to connect its bore with the annulus, and a sleeve 26 is shiftable within the tubing string between positions closing the ports 25, as shown in FIG. 1A, and opening the ports, and thus, for reasons to be described to follow, venting well fluid in the tubing above the valve to the annulus.

Figure 2:
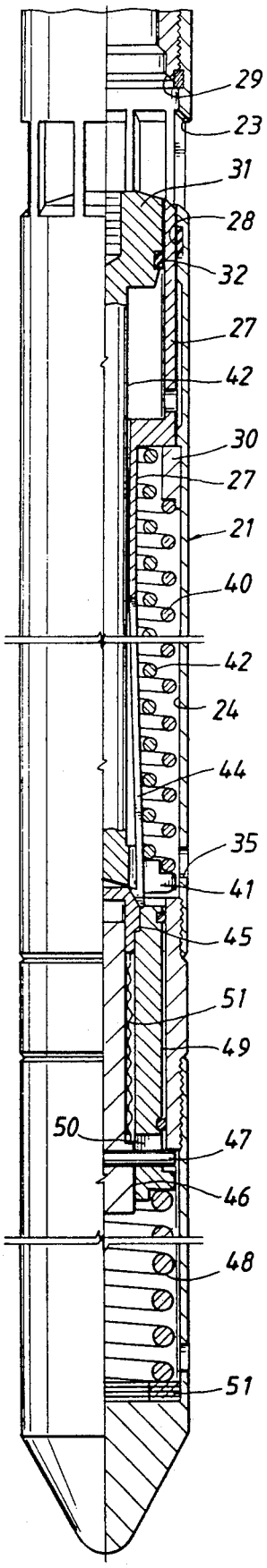
FIG. 2 is a view of the valve, similar to FIGS. 1A and 1B, and interrupted intermediate its length, but showing the one end of the bellows thereof raised to release the latch.

A sleeve 27 is vertically reciprocable within the bore of the body 21 between a lower position in which it opens the ports 23, as shown in FIGS. 1A, 1B and 2, and an upper position in which it closes the ports, as shown in FIGS. 3 and 4. More particularly, the sleeve is sealably slidable within packing 28 carried about the bore of the body 21. The upper end of the sleeve is engageable with a downwardly facing shoulder 29 in the body to limit its upward movement, and a downwardly facing shoulder on an intermediate portion of the sleeve is engageable with a ring 30 held within the body to limit its downward movement.

The valve also includes a piston 31 having packing 32 carried thereabout for sealably sliding within the upper end of the sleeve 27 between an upper position, as shown in FIGS. 1A, 2 and 4, and a lower position, as shown in FIG. 3. In its upper position, the piston 31 is on generally the same vertical level as the upper end of the sleeve 27 so as to not restrict flow through the ports 23 when the sleeve is open. When the sleeve is closed, and the piston raised, as shown in FIG. 4, the upper end of the piston engages a seat within the bore of the body to form a secondary closure inwardly of the seal 29 engaged by the sleeve. In its lower position, a shoulder about the upper end of the piston engages a shoulder about the inner side of the sleeve, as shown in FIG. 3.

As shown, ports 35 in an intermediate portion of the body permit well fluid in the annulus to enter the body beneath the piston. Thus, in the open of the valve shown in FIGS. 1A, 1B and 2, there is no pressure differential across the piston. On the other hand, when the valve is closed, as shown in FIG. 3, a greater well fluid pressure below the piston urges it upwardly with respect to the sleeve. Thus, as will also be described to follow, the differential pressure of the well fluid across the piston may be controlled in order to move it between raised and lowered positions and thereby generate and store energy to be used in opening and closing the valve, as described below.

A first coil spring 40 is disposed between the ring 30 and a flange 41 about the end of a lower extension of the piston for use in moving the sleeve 27 to its open position, and another coil spring 42 is disposed between the enlarged intermediate portion of the sleeve and the flange 41 for use in moving the sleeve to its closed position. More particularly, the sleeve has collet fingers 44 on its lower end which are releasably engageable with the lower side of the piston flange 41, when the piston is raised within the sleeve, to releasably connect the sleeve to the piston for downward movement therewith.

The valve remains in the position of FIGS. 1A and 1B until the rate of flow of well fluid therethrough increases above a certain level, thereby causing the pressure of the well fluid to drop below a predetermined level. When this occurs, the upper end 45 of a bellows installed in the lower portion of the body expands upwardly with respect to the lower end 46 thereof, which is fixed against vertical movement with respect to the body 21, to engage and thus wedge the lower ends of the collet fingers 44 outwardly to the releasing position of FIG. 2. As shown, the upper end of the bellows has tapered surfaces which slide over corresponding tapered surfaces on the lower ends of the collet fingers for facilitating the release thereof.

Upon release of the collet fingers, the sleeve 27 is free to move upwardly to its closed position, as shown in FIG. 3, due to the energy stored in the closing spring 42. At this time, a build up in the pressure of well fluid beneath the piston will create an upwardly acting pressure differential thereacross to urge the piston upwardly against the downward force due to the opening spring 40. Thus, the piston moves upwardly to its raised position with respect to the sleeve, and thus into seated engagement to the upper tubular body, as shown in FIG. 4, thereby compressing both the opening and closing springs, as shown in FIG. 4.

The piston will remain in its upper position until the pressure differential acting upwardly across it is decreased, as may occur, for example, upon an increase in the well head pressure, or opening of the movement of the sleeve 26 to open the ports 25 of the equalizing valve, thus permitting well fluid in the annulus to enter the tubing spring above the piston. At this time, the piston is caused to move downwardly, and, through the latch, move the sleeve downwardly with it to the open position of the valve shown in FIGS. 1A and 1B. As previously mentioned and as described below, the valve is thus returned to a position from which it may be caused to close in response to a predetermined drop in the pressure of the well fluid.

In its preferred embodiment shown in FIGS. 1A and 1B, 2, 3 and 4, the lower end 46 of the bellows is held downwardly in the body by means of a pin 47 which extends through it and whose ends are beneath a downwardly facing shoulder about the bore of the body of the valve. The upper end 45 of the bellows is yieldably urged upwardly by means of a coil spring 48 compressed between an outer tubular body 49 extending downwardly from the upper end 45 and the lower closed end of the valve body. More particularly, the pin 47 is received through slots 50 formed in the tubular member 49 to limit upward movement of the upper end 45 of the bellows under the urging of the spring 48.

The spring 48 is so selected as to cause the upper end of the bellows 45 to expand with respect to the lower end, and thus release the collet fingers, in response to a predetermined drop in the pressure of the well fluid in and around of the bellows. Then, when the pressure of the well fluid increases, it urges the upper end 45 of the bellows back to it retracted position and thus causes the slots 50 to move downwardly into engagement with the pins 47. As shown, shims 51 are disposed beneath the lower end of the spring 48 to permit the compressive force of the spring to be adjusted, depending on the conditions under which the sleeve of the valve is to be released.

As previously described, the pleated, metal body of the bellows is welded to its upper and lower ends under atmospheric conditions, so that expansion of its upper end due to the urging of spring 48 will draw a vacuum within the bellows, thus negating in the tendency for the bellows to be sensitive to temperature changes, as might occur in the case of a nitrogen filled bellows. It is also preferred that a rod 51 extend upwardly from the lower end 46 of the bellows for disposal closely within the inside of the metal body of the bellows, and that the space between the bellows body and the rod be filled with oil or other non-compressible fluid to protect it against collapse radially inwardly in response to high pressures of the well fluid.

As previously indicated, the valve shown in FIG. 5, and indicated in its entirety by reference character 20A, may be identical to the valve 20, except for the construction of the bellows for releasing the latch connecting the sleeve for downward movement with the piston. Thus, the bellows shown in FIG. 5 is of conventional construction having an upper end 55 which is urged upwardly with respect to its lower end fixed to a flange 56 on the inner side to contain nitrogen gas contained within the metal body of the bellows. More particularly, and as well known in the art, the nitrogen is charged to a pressure at which it is caused to move upwardly to release the latch when the well pressure urging it downwardly has dropped below a certain level. Upward movement of the upper end of the bellows is limited by means of a nut 57 about the lower end of a rod 58 depending from the upper end 55 and through flange 56 for engaging the lower end of the flange.

Reviewing now the overall operation of the valve, and assuming that it is in the position of FIG. 4 to close the ports 23 and generate and store energy in both of the opening and closing springs, the valve may be moved to the open position of FIGS. 1A and 1B by a decrease in the differential pressure acting upwardly across it. Thus, this causes the piston to move downwardly under the urging of the opening spring 42, and, as it moves downwardly, its lower end engages the lower ends of the collet fingers to move the sleeve downwardly with the piston to the open position of FIG. 1A.

At this time, however, the lower ends of the collet fingers are above the retracted upper end of the bellows so that they are not moved to positions releasing the sleeve for upward movement. This of course is the normal operating position of the valve to permit the flow of well fluid into the tubing string. However, upon a predetermined decrease in the pressure of well fluid in and around the bellows, the upper expandable end thereof is moved upwardly to release the lower ends of the collet fingers from the flange 41 at the lower end of the piston, as shown in FIG. 2. At this time then, the sleeve is free to be moved upwardly by energy generated in the opening spring 42, so as to close the ports 23.

With the valve in this closed position, the piston will move upwardly to its raised position with respect to the sleeve in response to an increase in the pressure differential acting upwardly across the piston. As the piston moves upwardly, the flange on its lower end moves upwardly past the lower ends of the collet fingers, as shown in FIG. 4, such that the piston is returned to a position in which it will move downwardly with the sleeve.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A subsurface tubing safety valve, comprising a tubular body adapted to be installed in a tubing string suspended within a well bore and having a flowway therethrough, means including a closure member movable between positions opening and closing the flowway, means within the body and responsive to a predetermined differential pressure of well fluid across the closure member when in closed position for generating and storing energy for moving the closure member between opened and closed positions, means operable, in response to a predetermined change in the pressure differential of well fluid across the closure member, to release a portion of the energy for moving said closure member to open position, and means responsive to a predetermined increase in the rate of flow of well fluid within the body for releasing further energy for moving the closure member to closed position.

2. As in claim 1, wherein said releasing means is responsive to a predetermined decrease in the rate of flow of well fluid in the body for return to a position for releasing further energy upon return of the closure member to open position.

3. A subsurface tubing safety valve, comprising a tubular body adapted to be installed in a tubing string suspended within a well bore and having a flow way therethrough a closure member movable between body positions to open and close the flowway, means including a piston which, when the closure member is closed and in response to a predetermined differential pressure of well fluid across it, generates and stores energy for moving the closure member between its positions, and means operable in response to a predetermined change in the pressure differential across the piston for releasing a portion of the energy to move the closure member to open position, and means responsive to a predetermined increase in the rate of flow of the well fluid within the body for releasing further generated energy to move the closure member to closed position.

4. As in claim 3, wherein said releasing means is responsive to a predetermined decrease in the rate of flow of well fluid in the body for return to a position for releasing further energy upon return of the closure member to open position.

5. A subsurface tubing safety valve, comprising a tubular body adapted to be installed in a tubing string suspended within a well bore and having ports connecting its bore with the annulus about the body, a sleeve sealably reciprocable within the body between a lower position to open the ports and an upper position to close the ports, means including a piston sealably reciprocable within the sleeve between an upper limited position and a lower position and operable, when the sleeve is in its closed position and in response to a predetermined differential pressure of well fluid across the piston, to generate and store energy for moving the sleeve between its upper and lower positions, means operable, upon raising of the piston with respect to the sleeve, for releasably connecting the sleeve to the piston for downward movement with the piston, whereby, in response to a predetermined change in the pressure differential across the piston, generated energy is released to lower the sleeve with the piston to open the ports, and means which is responsive to a predetermined increase in the rate of flow of well fluid within the body, for releasing the connecting means and thereby permitting further generated energy to raise the sleeve to close the ports.

6. As in claim 5, wherein said releasing means is responsive to a predetermined decrease in the rate of flow of well fluid in the body for return to a position for releasing further energy upon return of the closure member to open position.

7. As in claim 5, wherein said connecting means comprises a latch on the lower end of the sleeve which is normally urged to a position connected to the piston and yieldable upon engagement by the releasing means to a position releasing the piston.

8. As in claim 7, wherein the latch comprises a collet having fingers with tapered faces, and the releasing means has a tapered surface for sliding over the tapered faces to wedge the fingers outwardly to released position.

9. A subsurface tubing safety valve, comprising a tubular body adapted to be installed in a tubing string disposed in a well bore and having ports connecting its bore with the annulus about the body, a sleeve sealably slidable within the bore of the body between an upper position to close the ports and a lower position to open the ports, a piston sealably slidable within the sleeve between an upper limited position and a lower position, a closing spring acting between the piston and sleeve, an opening spring acting between the sleeve and body, said piston being raised to its upper limited position in response to a predetermined increase in the pressure differential of well fluid acting upwardly across it, when said sleeve is in its upper position to close the ports, whereby energy is generated and stored in both springs, means operable, upon raising of the piston with respect to the sleeve, for releasably connecting the sleeve to the piston for downward movement with piston, whereby, in response to a predetermined decrease in the pressure differential acting upwardly across the piston, energy generated in the opening spring is released to lower the sleeve with the piston to open the ports, and means responsive to a predetermined increase in the rate of flow of well fluid within the body, for releasing the connecting means and thereby permitting energy generated in the closing spring to raise the sleeve to close the ports.

10. As in claim 9, wherein said releasing means is responsive to a predetermined decrease in the rate of flow of well fluid in the body for return to a position for releasing further energy upon return of the closure member to open position.

11. As in claim 9, wherein said connecting means comprises a latch on the lower end of the sleeve which is normally urged to a position connected to the piston and yieldable upon engagement by the releasing means to a position releasing the piston.

12. As in claim 11, wherein the latch comprises a collet having fingers with tapered faces, and the releasing means has a tapered surface for sliding over the tapered faces to wedge the fingers outwardly to released position.

13. A subsurface tubing safety valve, comprising a tubular body adapted to be installed in a tubing string suspended within a well bore and having a flowway therethrough, means including a closure member movable between positions opening and closing the flowway, means within the body and responsive to a predetermined differential pressure of well fluid across the closure member when in closed position for generating and storing energy for moving the closure member between opened and closed positions, means operable, in response to a predetermined change in the pressure differential of well fluid across said closure member to release a portion of the energy for moving said closure member to open position, and means which is expandable in response to a predetermined drop in pressure of the well fluid within the body for releasing further energy for moving the closure member to closed position.

14. As in claim 13, wherein said releasing means includes a bellows having one end which is expandable with respect to its other end to engage and release the connecting means.

15. As in claim 14, wherein the releasing means also includes means limiting movement of the one end of the bellows with respect to its other end, and a spring compressed between the one end and the body to yieldably urge the one end upwardly to releasing position.

16. As in claim 15, wherein said releasing means also includes a rod fitting closely within the bellows, and liquid filling the space between the bellows and rod when the one end of the bellows is retracted.

17. A subsurface tubing safety valve, comprising a tubular body adapted to be installed in a tubing string suspended within a well bore and having a flow way therethrough a closure member movable between body positions to open and close the flowway, means including a piston which, when the closure member is closed and in response to a predetermined differential pressure of well fluid across it, generates and stores energy for moving the closure member between its positions, means operable responsive to a predetermined change in the pressure differential across the piston for releasing a portion of the energy to move the closure member to open position, and means which is expandable in response to a predetermined pressure drop in the well fluid within the body for releasing further generated energy to move the closure member to closed position.

18. As in claim 17, wherein the releasing means is retractable, as the well fluid pressure rises upon movement of the closure member to closed position, to a position from which it may again be expanded to release further generated energy upon return of the closure member to open position.

19. As in claim 17, wherein said releasing means includes a bellows having one end which is expandable with respect to its other end to engage and release the connecting means.

20. As in claim 19, wherein the releasing means also includes means limiting movement of the one end of the bellows with respect to its other end, and a spring compressed between the one end and the body to yieldably urge the one end upwardly to releasing position.

21. As in claim 20, wherein said releasing means also includes a rod fitting closely within the bellows, and liquid filling the space between the bellows and rod when the one end of the bellows is retracted.

22. A subsurface tubing safety valve, comprising a tubular body adapted to be installed in a tubing string suspended within a well bore and having ports connecting its bore with the annulus about the body, a sleeve sealably reciprocable within the body between a lower position to open the ports and an upper position to close the ports, means including a piston sealably reciprocable within the sleeve between an upper limited position and a lower position and operable, when the sleeve is in its closed position and in response to a predetermined differential pressure of well fluid across the piston, to generate and store energy for moving the sleeve between its upper and lower positions, means operable upon raising of the piston with respect to the sleeve for releasably connecting the sleeve to the piston for downward movement with the piston, whereby in response to a predetermined change in the pressure differential across the piston, generated energy is released to lower the sleeve with the piston to open the ports, and means which is expandable in response to a predetermined pressure drop in the well fluid within the body, for releasing the connecting means and thereby permitting further generated energy to raise the sleeve to close the ports.

23. As in claim 22, wherein said releasing means is retractable as the well fluid pressure rises upon closing of the sleeve to a position from which it may again be expanded to release said connecting means upon lowering of the sleeve with the piston.

24. As in claim 23, wherein said releasing means includes a bellows having one end which is expandable with respect to its other end to engage and release the connecting means.

25. As in claim 24, wherein the releasing means also includes means limiting movement of the one end of the bellows with respect to its other end, and a spring compressed between the one end and the body to yieldably urge the one end upwardly to releasing position.

26. As in claim 25, wherein said releasing means also includes a rod fitting closely within the bellows, and liquid filling the space between the bellows and rod when the one end of the bellows is retracted.

27. As in claim 22, wherein said connecting means comprises a latch on the lower end of the sleeve which is normally urged to a position connected to the piston and yieldable upon engagement by the releasing means to a position releasing the piston.

28. As in claim 27, wherein the latch comprises a collet having fingers with tapered faces, and the releasing means has a tapered surface for sliding over the tapered faces to wedge the fingers outwardly to released position.

29. A subsurface tubing safety valve, comprising a tubular body adapted to be installed in a tubing string disposed in a well bore and having ports connecting its bore with the annulus about the body, a sleeve sealably slidable within the bore of the body between an upper position to close the ports and a lower position to open the ports, a piston sealably slidable within the sleeve between an upper limited position and a lower position, a closing spring acting between the piston and sleeve, an opening spring acting between the sleeve and body, said piston being raised to its upper limited position, in response to a predetermined increase in the pressure differential of well fluid acting upwardly across it when said sleeve is in its upper position to close the ports, whereby energy is generated and stored in both springs, means operable upon raising of the piston with respect to the sleeve for releasably connecting the sleeve to the piston for downward movement with piston, whereby in response to a predetermined decrease in the pressure differential acting upwardly across the piston, energy generated in the opening spring is released to lower the sleeve with the piston to open the ports, and means which is expandable is in response to a predetermined pressure drop in the well fluid within the body for releasing the connecting means and thereby permitting energy generated in the closing spring to raise the sleeve to close the ports.

30. As in claim 29, wherein said releasing means is retractable as the well fluid pressure rises upon closing of the sleeve to a position from which it may again be expanded to release said connecting means upon lowering of the sleeve with the piston.

31. As in claim 30, wherein said releasing means includes a bellows having one end which is expandable with respect to its other end to engage and release the connecting means.

32. As in claim 31, wherein the releasing means also includes means limiting movement of the one end of the bellows with respect to its other end, and a spring compressed between the one end and the body to yieldably urge the one end upwardly to releasing position.

33. As in claim 32, wherein said means for releasing the connecting means also includes a rod fitting closely within the bellows, and liquid filling the space between the bellows and rod when the one end of the bellows is retracted.

34. As in claim 29, wherein said connecting means comprises a latch on the lower end of the sleeve which is normally urged to a position connected to the piston and yieldable upon engagement by the releasing means to a position releasing the piston.

35. As in claim 34, wherein the latch comprises a collet having fingers with tapered faces, and the releasing means has a tapered surface for sliding over the tapered faces to wedge the fingers outwardly to released position.

* * * * *